US007997434B2

(12) United States Patent
Benetti

(10) Patent No.: US 7,997,434 B2
(45) Date of Patent: Aug. 16, 2011

(54) BOTTLE, IN PARTICULAR ADAPTED TO CONTAIN BEVERAGES

(76) Inventor: Fabio Benetti, Sovizzo (IT)

( * ) Notice: Subject to any disclaimer, the term of this patent is extended or adjusted under 35 U.S.C. 154(b) by 435 days.

(21) Appl. No.: 12/087,629

(22) PCT Filed: Oct. 5, 2006

(86) PCT No.: PCT/EP2006/009617

§ 371 (c)(1),
(2), (4) Date: Jul. 10, 2008

(87) PCT Pub. No.: WO2007/090439

PCT Pub. Date: Aug. 16, 2007

(65) Prior Publication Data

US 2009/0001043 A1 Jan. 1, 2009

(30) Foreign Application Priority Data

Feb. 8, 2006 (IT) ..... VI2006A0044

(51) Int. Cl.
*B65D 23/10* (2006.01)

(52) U.S. Cl. ..... 215/376; 215/370; 215/371

(58) Field of Classification Search ..... 215/377, 215/370, 371, 376

See application file for complete search history.

(56) References Cited

U.S. PATENT DOCUMENTS

| | | | | |
|---|---|---|---|---|
| 2,365,888 A | | 12/1944 | Linderfelt et al. | |
| 2,805,351 A | * | 9/1957 | Van Rooy et al. | 335/210 |
| 3,089,605 A | | 5/1963 | Buonauro | |
| 3,402,844 A | * | 9/1968 | Chin | 215/393 |
| 3,526,335 A | * | 9/1970 | Swett et al. | 220/630 |
| 5,025,940 A | * | 6/1991 | Akly | 215/395 |
| 6,164,473 A | * | 12/2000 | Waldrip | 215/378 |
| 6,905,038 B2 | * | 6/2005 | Lopez | 215/228 |

FOREIGN PATENT DOCUMENTS

| | | |
|---|---|---|
| DE | 41 09 886 A1 | 10/1992 |
| DE | 296 19 811 U1 | 4/1997 |
| FR | 1 007 178 A | 5/1952 |
| WO | WO 99/37190 A | 7/1999 |
| WO | WO 02/076838 A2 | 10/2002 |

OTHER PUBLICATIONS

International Search Report.

* cited by examiner

*Primary Examiner* — Tri M Mai

(74) *Attorney, Agent, or Firm* — Bucknam and Archer

(57) ABSTRACT

There is provided a bottle, adapted in particular for containing beverages, wherein its bottom is not integral with the rest of the bottle, but is fixable to the aforesaid by means of reversible fixing means; in particular, the bottom can be screwed to the rest of the bottle. Once the bottle is rotated so that its bottom is turned upward, after having opened the bottom the bottle may be set, in opposition position to the normal positioning of the aforesaid bottle, atop this bottom, where there are present means of locking and clasping with the part normally arranged on the top part of the bottle and with the related cap, this permitting the user to drink the contents of the bottle by bringing his lips to that which normally composes the bottom of the aforesaid bottle, naturally once it is open.

1 Claim, 4 Drawing Sheets

BOTTLE, IN PARTICULAR ADAPTED TO CONTAIN BEVERAGES

CROSS REFERENCE TO RELATED APPLICATIONS

Figure 1:
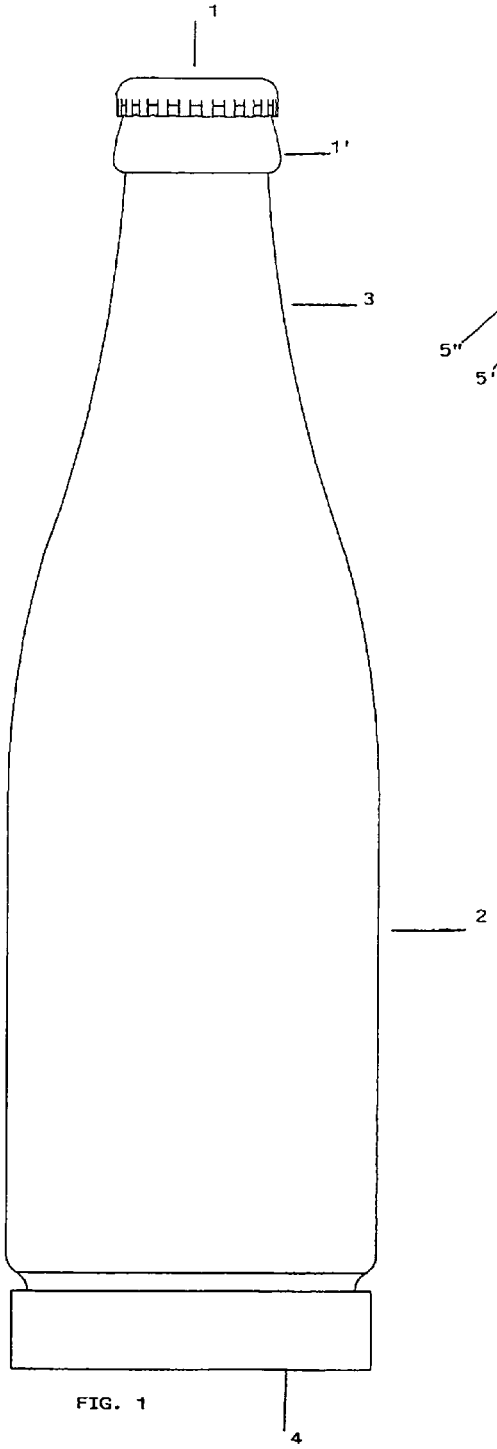

This application is the National Stage of PCT/EP2006/009617 filed on Oct. 5, 2006, which claims priority under 35 U.S.C. §119 of Italian Application No. VI2006A000044 filed on Feb. 8, 2006, the subject matter of which is herein incorporated by reference. The international application under PCT article 21(2) was published in English.

The present finding regards a bottle, in particular adapted to contain beverages.

It is known that the bottles adapted to contain beverages have, in most cases, a structure with cylindrical symmetry with a lower part of substantially cylindrical shape and a flat bottom; this lower part, continuing upward, is intended to get gradually narrower, composing the so-called "neck" of the bottle, which then terminates on the top with an opening, closable by means of a suitable cap, from which the user may let the drink contained in the bottle come out when he desires and for the desired quantities. In the bottles placed on the market in the normal distribution channels (stores, supermarkets and commercial shops in general) the cap is always sealed, so to permit comprehending if the seal was broken and if the user is the first person who has accessed the inside of the bottle itself. In particular, the so-called crown caps, made in metal material and openable by means of a lever opener, or the so-called screw caps, which foresee the presence of a thread both on the mouth of the bottle and at their inner surface are known. Another type of cap consists of the so-called cork, traditionally made in cork oak, but now also made by means of appropriate plastic materials, which is forcibly inserted in the mouth itself, causing its closure. As already said above, whatever the type of bottle closure, seals are always placed around the cap, generally composed of small shells of plastic material, tinfoil or the like which must be irreversibly torn in order to permit the opening of the cap, thus immediately permitting one to recognise if the bottle has been opened.

At present, the cork is reserved for closing bottles containing prestigious wine, liquors and beers.

It is also known that, once the bottle is open, the user must generally pour the contents of the aforesaid into a glass in order to drink the beverage. It is clear that, generally, the user could also drink the beverage directly by bring the mouth of the bottle neck to his lips, but this manoeuvre is not favoured by many users and is in any case absolutely inadvisable in the case in which a plurality of users must drink from the same bottle, for hygienic reasons. In fact, this manoeuvre is generally carried out by the user who wishes to drink the beverage (generally beer) from a small capacity bottle (up to 33 cl), or, in case of need, when it is absolutely impossible to have available a glass for drinking the beverage.

It should also be noted that, in the case wherein the user consumes the beverage in a public establishment, the manager of the establishment will have to clean the glass after it has been used, with evident need of manpower to carry out such operation, also in the case in which automatic means are used such as dishwashers and the like.

Moreover, in the case in which the glasses are washed in a non-adequate manner, bacteria, viruses and other pathogenic agents can be transmitted. The object of the present finding is that of foreseeing a bottle, adapted in particular for containing beverages, which can be easily transformed into a glass, allowing the user to easily drink the beverage even in the case wherein the aforesaid is not drunk at home or in a public establishment.

Such bottle must moreover lack structural and functional complexity, so that its cost is comparable to that of the bottles of known type and it is as easy to use as those of the aforesaid bottles.

This is obtained, according to the finding, by foreseeing that the bottom of the bottle is not integral with the rest of the bottle itself, and is on the other hand fixable to the aforesaid by means of reversible fixing means.

In this manner, once the bottle is opened, no long by acting on the present cap normally present at the upper mouth of the same, but on said openable bottom, naturally with the bottom turned upward and the mouth turned downward, the user has a structure available which is entirely similar to a glass, from which he can drink without any problem.

To assist the user in this use it is possible to foresee that the bottom is also equipped with a reception seat for the end of the bottle neck, which acts therefore as a support element for the bottle, which therefore can be set without any problem on tables or in any case on any flat surface, facilitating the user's use.

These and other characteristics of the finding will now be described in detail, in several of its particular embodiments, made as a not limiting example with the aid of the attached drawing tables, where:

In FIG. 1 (TAV 1-TABLE 1) a bottle is represented, made according to the finding, of the type which has a crown cap.

Figure 2:
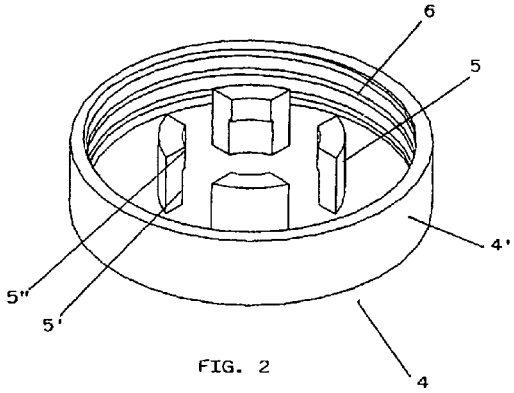

In FIG. 2 the bottom of the aforesaid bottle is illustrated.

Figure 3:
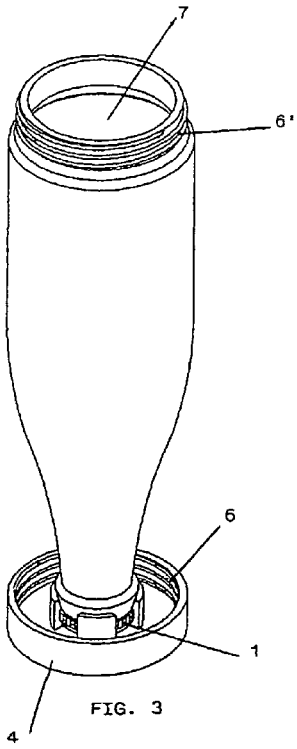

In FIG. 3 such bottle is illustrated in real use conditions.

Figure 4:
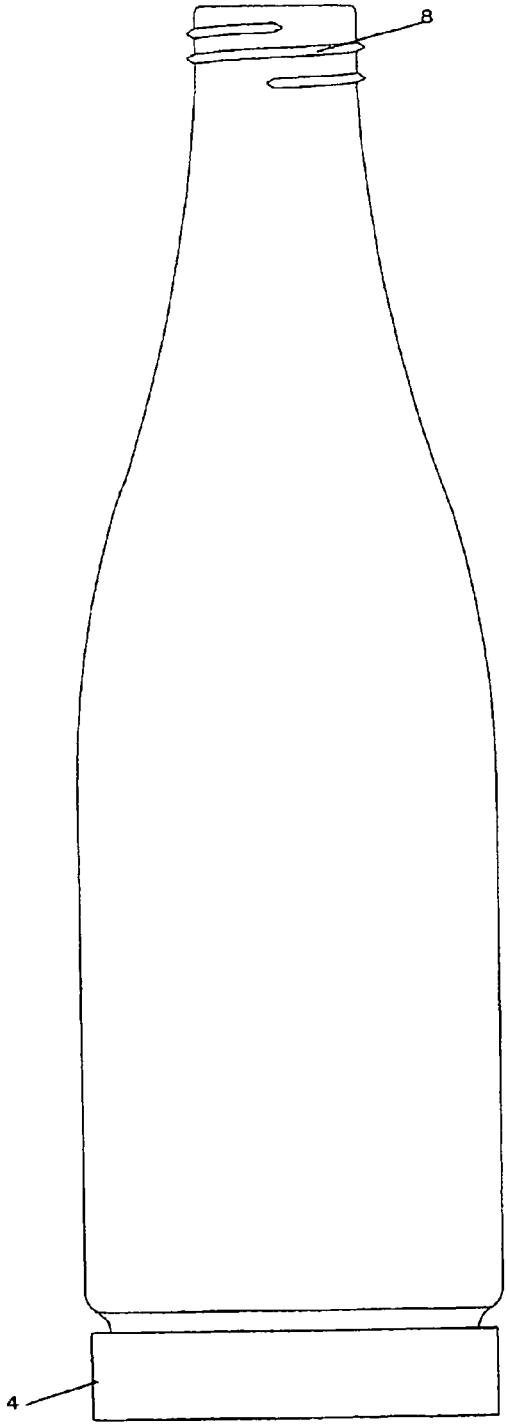

In FIG. 4 (TAV II-TABLE II) a bottle is illustrated, made according to the finding, which does not have any opening at its upper mouth.

Figure 5:
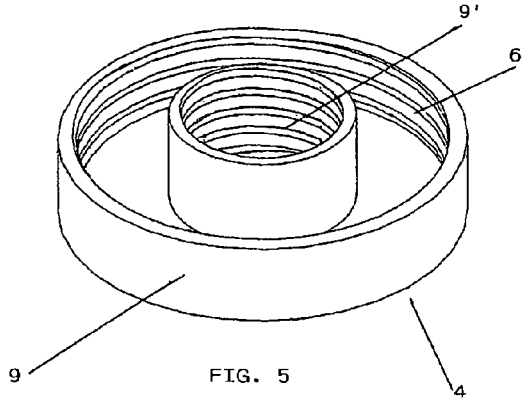

In FIG. 5 the bottom used in such bottle is illustrated.

Figure 6:
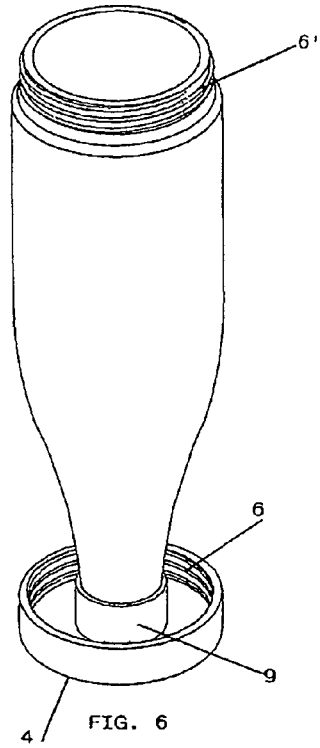

In FIG. 6 the aforesaid bottle is illustrated in real use conditions.

Figure 7:
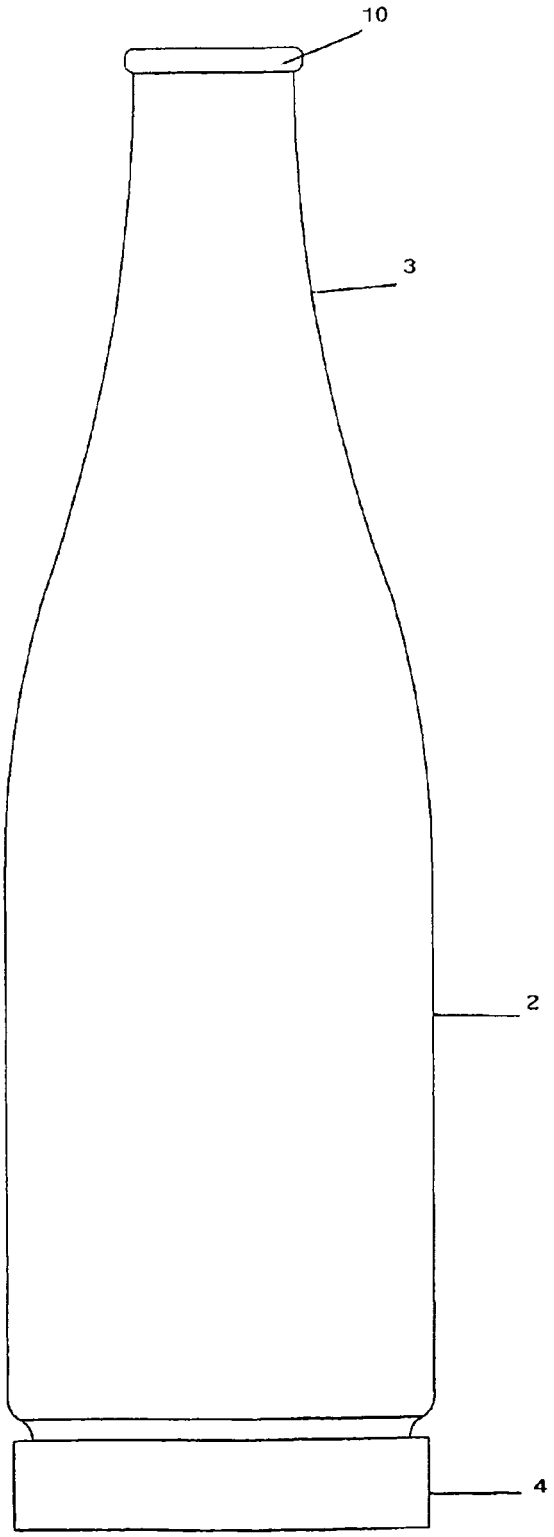

In FIG. 7 (TAV III-TABLE III) another bottle is illustrated, made according to the finding, which does not have any opening at its upper mouth.

Figure 8:
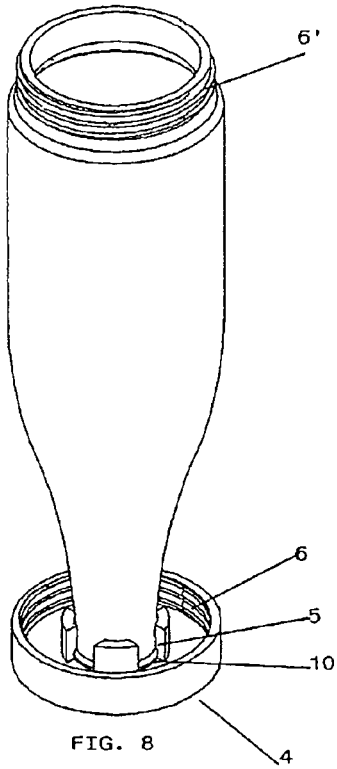

In FIG. 8 the aforesaid bottle is illustrated in real use conditions.

Figure 10:
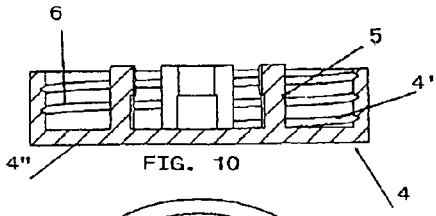
Figure 9:
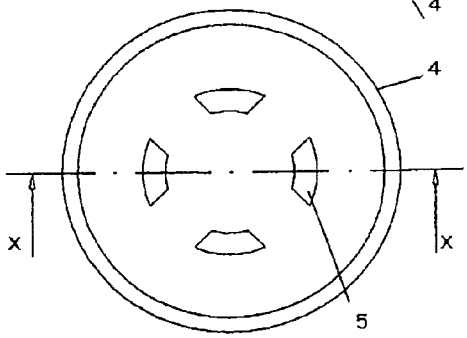

In FIGS. 9 and 10 (TAV IV-TABLE IV) two views are respectively illustrated, a top plan view and a vertical section view, along the line X-X of FIG. 9, of the bottom of a bottle according to the finding, which uses a crown cap or lacks an upper opening cap, as in FIGS. 7 and 8.

Figure 12:
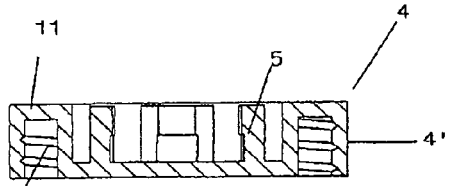
Figure 11:
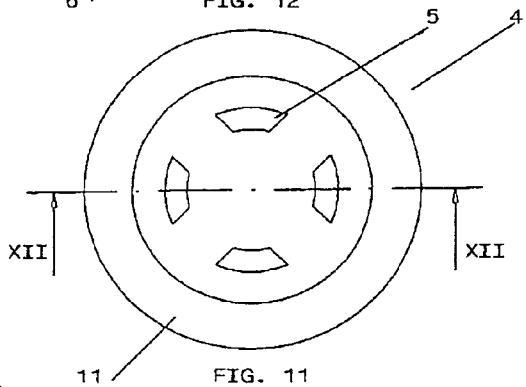

Respectively illustrated in FIGS. 11 and 12 are a top plan view and a vertical section view, along the line XII-XII of FIG. 9, of an alternative version of the above bottom type.

Figure 14:
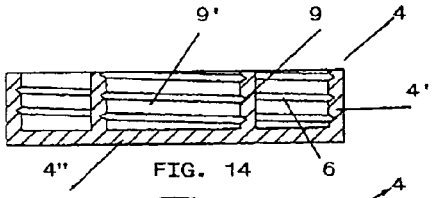
Figure 13:
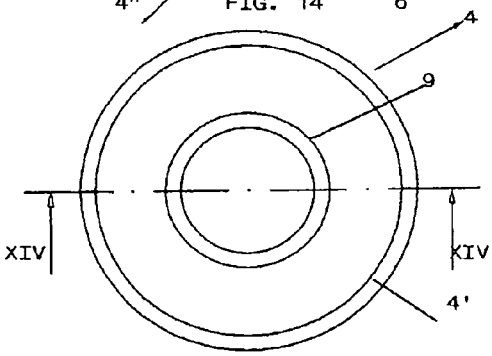

Respectively illustrated in FIGS. 13 and 14 are a top plan view and a vertical section view, along the line XIV-XIV of FIG. 13, of a bottle bottom according to the finding, of the type according to FIGS. 4-6.

Figure 16:
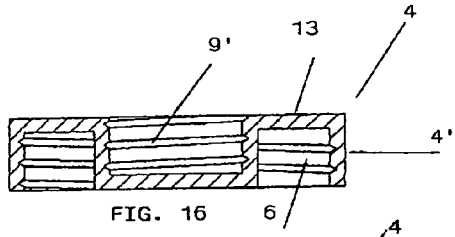
Figure 15:
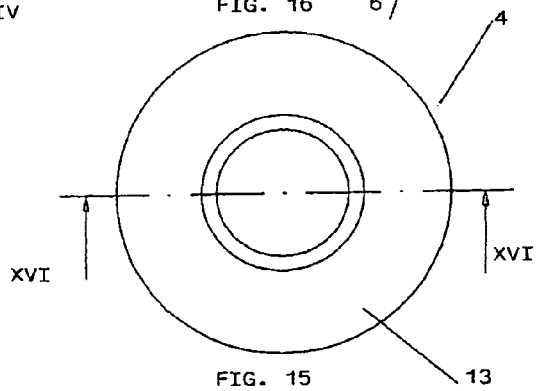

Respectively illustrated in FIGS. 15 and 16 are a top plan view and a vertical section view, along the line XVI-XVI of FIG. 15, of an alternative version of the above bottom type.

As is visible in FIG. 1, the bottle according to the finding, in a first embodiment thereof, is closed by a normal cap 1 and foresees, in a customary manner, a lower cylindrical portion 2 intended to become gradually narrower at its neck 3, in whose upper end a mouth is present which is closed by the crown cap 1.

According to the finding, it is foreseen that the bottom 4 of the bottle is not integral with the rest of the aforesaid bottle, but is fixable to the aforesaid by means of screwing. In practice, the lower end of the lower cylindrical portion of the bottle is externally equipped with a thread, to which the internally threaded lateral extension 4' can be screwed; the lateral extension 4' rises from the bottom 4.

At the central part of said bottom, projections 5 are foreseen, in this case four in number are foreseen, arranged angularly spaced on a same concentric circumference with respect to the bottom 4, inside of which the mouth of the bottle neck is housed, exactly as illustrated in FIG. 3. To permit the support of the bottle, the projections 5 have, at their outer surface, a surface 5', placed lower down with respect to the normal positioning of the bottom 4, slightly more indented with respect to the overlying part 5", which is on the other hand inwardly jutting. In this manner, the four projections are adapted to clasp the crown cap 1 of the bottle (FIG. 3), which comes into contact with the portions 5' arranged on the lower part of the projections 5, remaining locked by the portions 5". In this manner, the bottle can remain in vertical position, with the cap arranged below, while the opening of the bottle is found in that which once was the bottom of the aforesaid bottle, now placed on the top. In practice, the bottom 4 acts as a support of the entire structure and the bottle is configured as a glass from which the user can drink the contents of the bottle by bringing his lips to the edge of the mouth 7, previously closed by the bottom 4. Naturally, in practice, a seal will be foreseen in the connection zone between the bottom 4 and the rest of the bottle 2, seal which obviously will be broken in the bottle opening step, thus to ensure the consumer that the bottle has not been previously opened before use.

The device according to the finding is also adapted to be used with bottles whose upper mouth is closed in a permanent manner, as is visible in FIG. 4. In this case, the openable bottom 4 of the bottle has a cylindrical structure 9, with internal thread 9', into which the mouth of the bottle is insertable, being equipped with external thread 8, arranged hence as in FIG. 6, engaging with the internal thread 9' of said structure 9.

The modes of use of this device do not differ from those illustrated above.

In FIGS. 7 and 8, a further bottle is seen which lacks the opening at its upper end. In practice, also with this structural device, the bottle according to the finding can only be opened by unscrewing the bottom 4; to permit the clasping of the bottle onto a structure similar to that described in the first embodiment of the finding at the end of the bottle neck, an annular projection 10 is foreseen which physically simulates the presence of the crown cap 1, so to permit its clasping with the projections 5 which emerge from the bottom 4.

Observing FIGS. 9 and 10, one sees that the thread 6, which comes into engagement with the corresponding thread 6' present in the open end of the bottle, is made at the inner surface of the edge 4' projecting upward with respect to the bottom surface 4" of the bottom 4.

On the other hand, in the alternative solution illustrated in FIGS. 11 and 12, the thread 6 is always made at the inner surface of the lateral edge 4' of the bottom 4, but this lateral edge is turned downward beginning from an annular element 11 placed substantially at the same level of the upper ends of the projections 5. In fact, with this particular embodiment, the bottom 4, in the passage from the position wherein the closure of the lower end of the bottle is carried out, to the position wherein it acts as a support means for the aforesaid, must be rotated 180°.

The same also occurs for the two embodiments respectively illustrated in FIGS. 13-14 and 15-16 related to the embodiment of FIGS. 4-6. In fact, in the first embodiment, illustrated in FIGS. 13 and 14, it is seen that the threads 6 and 9' are made on concentric cylindrical edges 4' and 9, which both rise from the bottom surface 4" of the bottom 4.

On the other hand, in the solution illustrated in FIGS. 15 and 16, the thread 6 for the screwing with the bottom of the bottle is also made at the inner surface of the lateral edge 4', but the latter is integral and extends downward beginning from a circular crown 13 placed at the upper end of the central thread 9' in which the narrow end of the bottle is engaged, wherein the thread 8 is present (FIG. 4). In practice, also in this embodiment the bottom 4 must be rotated 180°, beginning from the situation illustrated in FIG. 4, so to be able to use it in the position illustrated in FIG. 6.

From that stated above it is therefore clear how the bottle according to the finding, in all of its particular embodiments, can be easily transformed into a glass ready for serving the beverage contained inside the bottle. Once the beverage has been completely consumed, the bottle can be recycled by advantageously selecting its various components based on their constituent materials. As an example, in the case wherein the bottle is made, for example, in glass, with the bottom made in plastic material, while the cap is metal (as it normally is), these three elements may be separated and placed in the correct containers for the separate recycling collection. In this manner, the user has available a simple and practical mode for beverage consumption, freeing himself from the task of having to wash a glass in which he had previously poured the drink itself.

It must also be considered that in order to use the bottle according to the finding, drinking from its bottom, it is necessary to previously overturn it by bringing the aforesaid bottom to the top. This manoeuvre can clearly make possible holes visible in the bottle neck, by means of which an ill-intentioned individual has inserted poisonous substance in the same (for example trichloroethylene and bleach), as unfortunately has occurred in numerous recent cases as pointed out by the news.

The use of the bottle occurs with extreme ease, without the need to use particular tools or expedients, with the maximum guarantee of the user's hygiene. One should note that the bottle, the bottle caps, as well as the bottoms present in the bottle can assume forms and aspects which are also different from those described and illustrated here, and they can also be made in any material adapted for the object, without departing from the scope of the present patent.

Finally, the bottle according to the finding can be made in any material (for example in glass or plastic material).

The invention claimed is:

1. A bottle adapted for containing beverages, comprising:

a) a body (2) having in a normal configuration condition an upper mouth closed by a crown type cap (1) and a lower end having an open mouth (7) and an external thread (6');

b) a bottom (4), not integral with said body (2), having a substantially cylindrical lateral extension (4') rising from said bottom (4), said lateral extension (4') having an internal thread complementary to the external thread (6') at the lower end of said body (2) and fixable therewith to thereby close said open mouth (7) at the lower end of said body (2) and permit the bottle to rest on an underlying surface in the normal configuration condition; and c) a plurality of projections (5) projecting from a central part of said bottom (4) arranged along a circle concentric with said bottom (4), each of said projections (5) having an inwardly extending surface (5") disposed above an indented surface (5') which defines between said projections a space into which the upper mouth closed by the crown type cap (1) is insertable so that the crown type cap (1) contacts the indented surfaces (5') and is locked in place by inwardly extending surfaces (5"), whereby the body (2) may be arranged in vertical position perpendicularly with respect to said bottom (4) so as to be disposed opposite to the normal configuration condition of the bottle to permit drinking from said open mouth (7) of said body (2).

* * * * *